US008572902B2

(12) United States Patent
Hamlin, III

(10) Patent No.: US 8,572,902 B2
(45) Date of Patent: Nov. 5, 2013

(54) METHOD FOR INSTALLATION OF ROOF INSULATION AND MEMBRANE ROOFING

(76) Inventor: Henry L. Hamlin, III, Macon, GA (US)

( * ) Notice: Subject to any disclaimer, the term of this patent is extended or adjusted under 35 U.S.C. 154(b) by 0 days.

(21) Appl. No.: 13/225,295

(22) Filed: Sep. 2, 2011

(65) Prior Publication Data

US 2012/0137629 A1 Jun. 7, 2012

Related U.S. Application Data

(60) Provisional application No. 61/379,579, filed on Sep. 2, 2010.

(51) Int. Cl.
*E04B 7/00* (2006.01)

(52) U.S. Cl.
USPC ..... 52/23

(58) Field of Classification Search
USPC ..... 52/23, 309.8, 404.4, 408, 409, 746.11, 52/DIG. 11, DIG. 12
See application file for complete search history.

(56) References Cited

U.S. PATENT DOCUMENTS

| | | | | | |
|---|---|---|---|---|---|
| 3,039,232 | A * | 6/1962 | Dunn | 52/396.04 |
| 4,441,295 | A * | 4/1984 | Kelly | 52/408 |
| 5,088,259 | A * | 2/1992 | Myers | 52/410 |
| 5,388,378 | A * | 2/1995 | Frye | 52/23 |
| 5,570,545 | A * | 11/1996 | Adams | 52/23 |
| 7,028,438 | B2 * | 4/2006 | Burdic | 52/409 |
| 7,484,334 | B1 * | 2/2009 | Oviedo-Reyes | 52/23 |
| 2003/0145546 | A1 * | 8/2003 | Georgeau et al. | 52/408 |
| 2009/0307988 | A1 * | 12/2009 | Hamlin, III | 52/23 |

* cited by examiner

*Primary Examiner* — Christine T Cajilig
(74) *Attorney, Agent, or Firm* — Brian D. Bellamy

(57) ABSTRACT

A method for installing roof insulation includes adhering the insulation to a covering membrane material or retaining the insulation by an overlapping cross-bar, track or joint. Elongate cables stretch across the insulation and membrane material to secure the insulation and membrane material to roof deck.

9 Claims, 3 Drawing Sheets

METHOD FOR INSTALLATION OF ROOF INSULATION AND MEMBRANE ROOFING

PRIORITY CLAIM

The present application claims benefit of U.S. provisional patent application No. 61/379,579 filed on Sep. 2, 2010.

BACKGROUND OF THE INVENTION

The present invention relates to installation of foam roof insulation sheets and, particularly to a method of installation for these insulation sheets using reinforced membrane covering in lieu of glue or screws.

Insulation for commercial roofs is generally in sheets about ½" to 3" thick or more. As usual, thicker insulation installed in a roof or wall of a building improves energy efficiency. The foam sheets of insulation used in a common commercial building roof are installed by laying the sheets on top of a roof deck, which may be comprised of concrete, steel or wood. In recent history the roofing industry has transitioned from using asphalt on flat roofs to using TPO membranes for commercial buildings. Thermoplastic Olefin or Polyolefin (TPO) membranes are single-ply roof membranes constructed from ethylene propylene rubber. They are designed to combine the durability of rubber with the proven weather-proofing and durable performance of seams that are welded using hot air. These membranes are often installed over the insulation sheets of commercial roofs.

In previous construction techniques, the insulation sheets installed in commercial roof decks are usually secured to the roof deck first to avoid shifting when wind blows under the overlying membrane roof covering material. Wind uplift is a major problem in roofing with respect to both the roof covering and the underlying insulation. The insulation is installed before applying the membrane roofing to the roof. The insulation generally comprises sheets that are 4'×8' in size. The insulation sheets are installed by laying them side by side on the roof deck with the lap joints staggered. The joints of the insulation sheets are usually attached with screws and plates to the roof deck. Alternatively, it is common to glue the insulation sheets to a roof deck, or use hot asphalt where glue is unacceptable because of environmental hazards.

Existing means for securing insulation discussed above are both expensive and inefficient. For example, in the most common method of attaching insulation sheeting with screws and plates, the plates must be manually set and multiple screws must be installed in a multitude of plates. These screws and plates are difficult to remove in the case the roof needs the roof needs to be replaced. Hot asphalt is expensive, installation is energy-intensive, and it can be difficult to deliver to roof decks. Further, hot asphalt is not approved for installation of insulation directly to steel decks.

SUMMARY OF THE INVENTION

It would be advantageous to attached insulation sheets without the need to use expensive screws, glue or hot asphalt. A method is also needed to fasten insulation to a roof deck using the membrane structure that will be installed over the insulation sheets. Another method is needed to attach insulation separately to a roof deck without the need for screws, glue or asphalt.

The present invention provides for holding a roof system down from the top without the use of screws, or at least very few compared to traditional methods for installing roof installation sheets. In this regard, additional methods for attaching cables to retain roofing membranes together with insulation sheets are provided by the invention. The system provides for installation of insulation sheets from above using a cable fastening system, as opposed to attachment of the insulation sheets with screws attached below the sheets.

In particular, cables are laid selectively over the insulation sheets or roofing membrane. The cable or reinforced elongate member comprising the cable may be fastened to the membrane covering the insulation or fasted directly to the insulation sheets. In addition the roofing membrane may be attached to the insulation sheets by an adhering means such as hook and loop fastener, snap-locking members, or adhesive substance. Once the membrane is stuck onto the insulation sheets, wind cannot get under the roofing materials and blow the insulation around once the membrane or insulation sheets are secured using a cable system. Attaching the membrane to the insulation sheets will be advantageous to prevent shifting of the insulation when the cable system secures the membrane.

An object of the present invention is to improve efficiency of installation for foam insulation sheets.

Another object of the invention reduces the need for attaching foam insulation sheets form to a structure below the sheets with screens, adhesive or hot asphalt.

Still another object improves efficiency for removal of foam insulation sheets.

Still another object improves efficiency of installation of roof systems through combination of installing foam insulation sheets with the step of installing thermoplastic membrane material.

Yet another object provides an improved method for securing foam insulation sheets to a roof substrate in a manner that exceeds requirements for wind and weatherproofing.

DETAILED DESCRIPTION OF THE INVENTION

A new method of attaching insulation sheets 2 to membrane material 4 for securing the system with cable 6 is provided in the several embodiments depicted herein. Beginning now with FIG. 1, the preferred embodiments of the method include putting an adherent material 8, such as hook and loop fastener or heat activated glue on the top side of insulation sheets 2 like that shown in FIG. 1 for engaging and attaching to the membrane material 4 that is laid over the insulation sheets 2.

Figure 1:
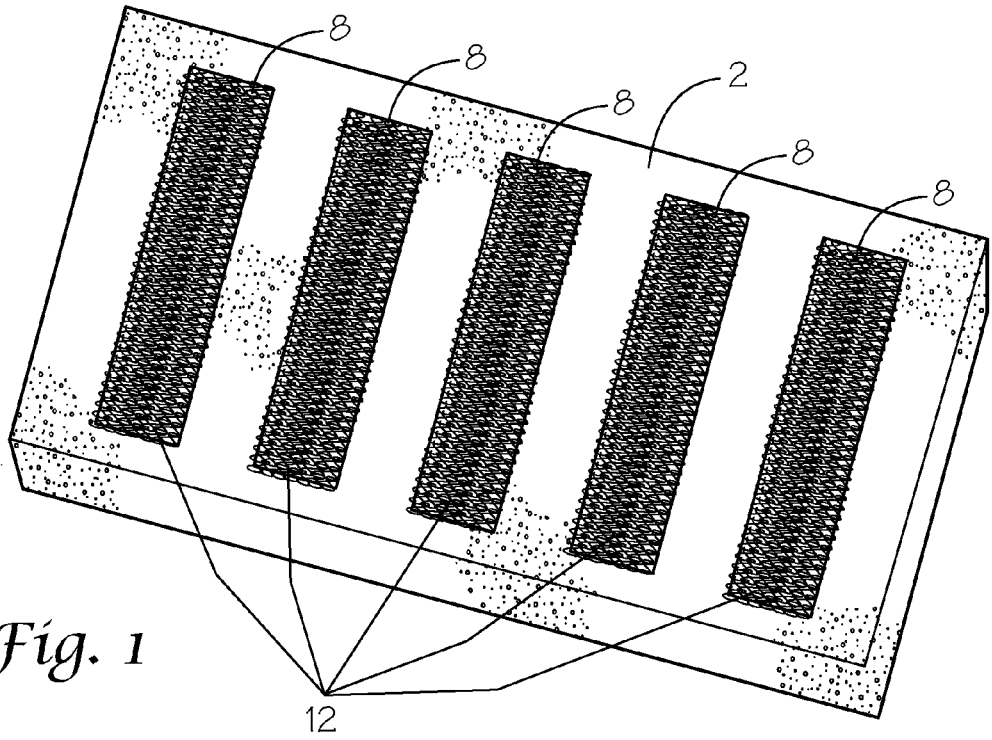
FIG. 1 is a perspective view of an insulation sheet modified with adherent hook and loop material in accordance with an embodiment of the invention.
Figure 2A:
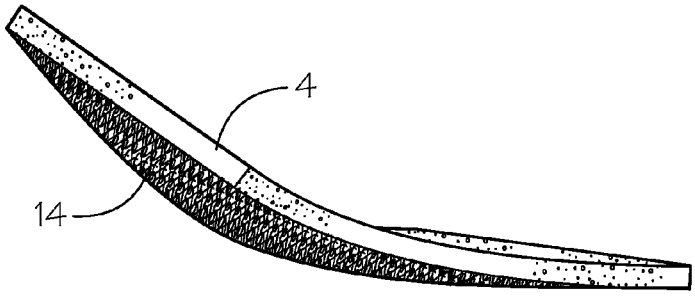
FIG. 2*a* is a perspective view of a membrane material modified with an adherent hook and loop material in accordance with an embodiment of the invention.
Figure 2B:
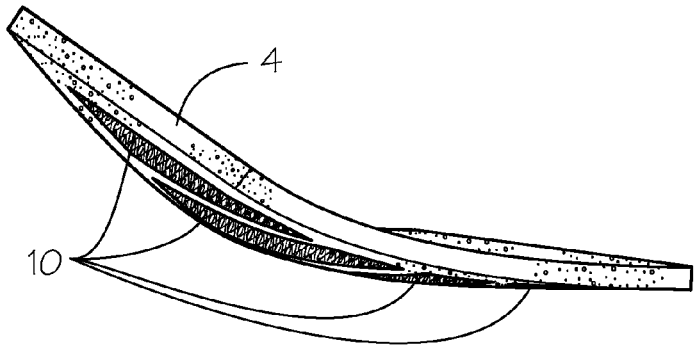
FIG. 2*b* is a perspective view of a membrane material modified with an adherent hook and loop material in an alternative embodiment of the invention.
Figure 3:
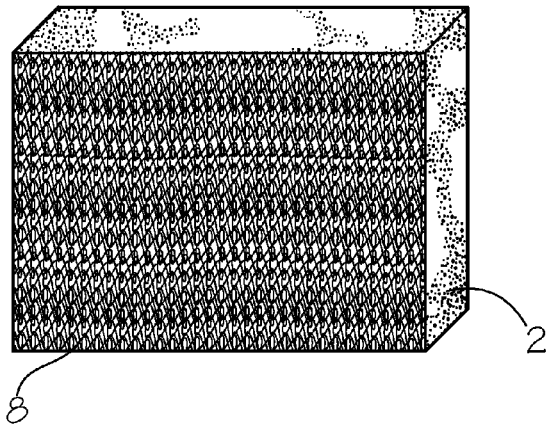
FIG. 3 is a perspective view of an insulation sheet modified with adherent material in an alternative embodiment of the invention.

For example, a hook and loop fastening material may be applied to the top side of the insulation sheets 2 in sections as shown in FIG. 1 or as a unitary layer of material as shown in FIG. 3, and, then, sectional strips 10 of hook and loop attaching material may be manufactured into the rolls of membrane material 4 or as a unitary solid backing. Whereby, when the membrane material 4 is rolled out over the insulation sheets 2, as depicted in FIGS. 2*a* and 2*b*, and the membrane material will attach itself to the insulation sheets 2. The provision of adherent material on surfaces of both the membrane material and the insulation sheets is a first step toward providing a secure installation of the insulation sheets without the need for attaching the bottom side of the insulation sheets to a roof substrate with screws, adhesive or asphalt.

After the membrane material is attached to the insulation by contact of the adherent top surface of the insulation surface with adherent bottom surface of the membrane material, cable is used in a further step of the process to securing the membrane and insulation sheets. Elongate cable 6 may comprise any elongate cord or material of sufficient strength for stretching across membrane material 4 on a roof deck and securing the cable to the roof deck with sufficient force to retain the membrane material and resist wind and other weather or elements. In particular, the cable 6 may comprise an elongate member of membrane material, which may be reinforced by layering, fiber, or integrated cord or cable. It is further recognized that adherent material may only be required on either the top surface of the insulation sheet or bottom surface of the membrane material should heat activated glue or other adherent be used that only requires one surface contain adherent material. Whereas, when the preferred hook and loop fastener is used, it will be desirable for both the insulation sheet surface and membrane material surface to be treated with adhering material of the hook and loop nature.

Once the membrane is secured with cable 6, the insulation sheets 2 would be unable to shift when exposed to windy conditions. Thus in one embodiment, the hook and loop fastening material is applied to the top side of the insulation sheets 2 in strips 12, and the membrane material 4 is manufactured with a solid hook and loop backing 14 as shown in FIG. 2*a* that attaches to these strips. In yet another embodiment, both the adherent material 8 applied to the top side of the insulation sheets 2 and the adherent material applied to the membrane backing are arranged in strips 10, 12 that are aligned for attachment of each to the other.

Alternatively, these strips 10, 12 may be crisscrossed for easier alignment, and, whereby the strips save material as compared with manufacturing a solid surface or backing of adherent material. A suitable material that will adhere the insulation sheets 2 to the membrane material 4 may be substituted for hook and loop fastener, such as snap-lock material, adhesive with pull off covering, or adhesive activated at the time of installation for securing the membrane material to the insulation sheets 2.

The membrane material is secured using several sections of elongate cable 6 crossing the membrane 4 and also the underlying foam insulation sheets 2. As the foam insulation sheets 2 are secured by the membrane material 4 layered thereon or the insulation sheets are secured from above by cross-bars 16, 18 or tracks 22 as discussed below, the several sections of cable 6 that cross the insulation sheets will secure both the insulation sheets and the membrane material. In particular, once the membrane material is secured to the roof deck by any means, the insulations sheets when attached to the membrane material will in turn be secured and tolerant to wind and other weather conditions. In one preferred embodiment, the membrane material over the insulation sheets is attached by cable 6, which will be fastened at or near to a perimeter edge of the building and then run in a direction perpendicular to the direction of the perimeter edge to which it is fastened. Several of these cables 6 will be a regular distance apart to secure the membrane, while crossing several insulation sheets as well.

Figure 4:
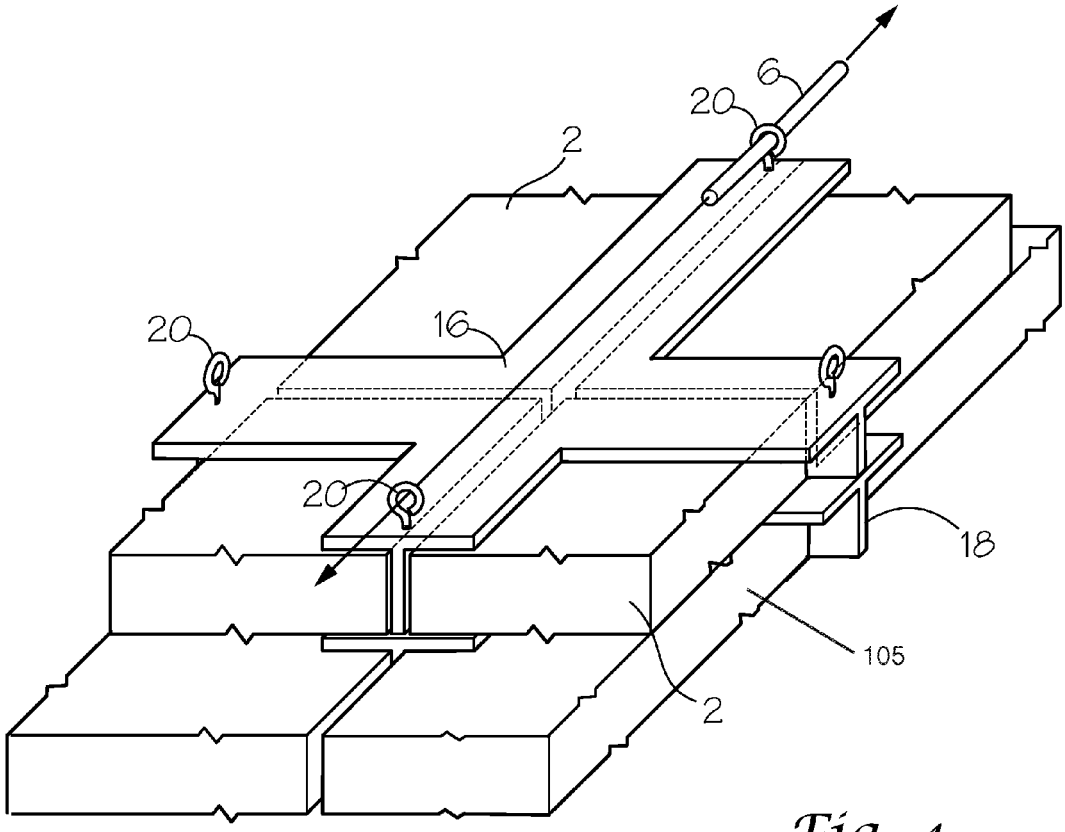
FIG. 4 is a perspective view of a method for installation of roof insulation in accordance with an embodiment of the invention.

In another embodiment depicted in FIG. 4, the insulation sheets 2 are held in place on the roof deck 102 by plates or cross-bars 16, 18 that fit over top of each or several insulation sheets 2 and hold each insulation sheet in place by grabbing onto a cross-bar on the bottom of the sheet. A pair of cross-bar plates may be arranged to overlap on the top and bottom with the top cross-bar 16 grabbing the bottom cross-bar 18 to secure them together. The cross-bars fit between the insulation sheets 2. One or more of the cross-bars may include adhesive for holding the insulation sheets 2. The top cross-bar may include eyelets 20, buckles, bracket or attachment means for the cable 6 or straps to engage or pass through to hold the top plate and thereby secure the plates and insulation sheets 2 in place. The system may be integrated with fitted pieces to provide a synergistic method for installation of insulation sheets 2.

Figure 5:
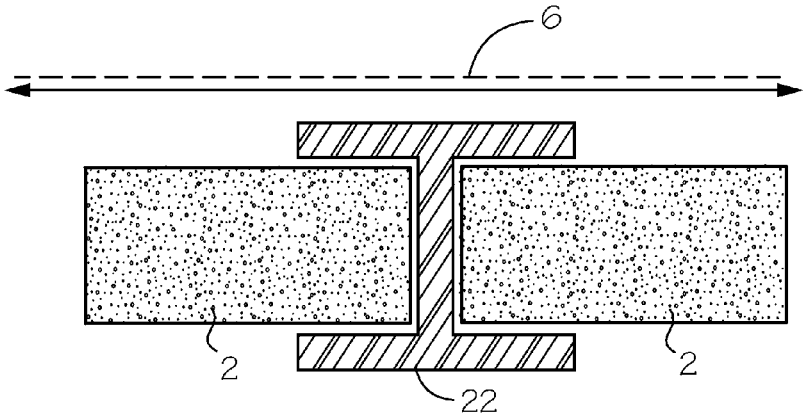
FIG. 5 is a perspective view illustrating an alternative method for installing roof insulation according to the invention.
Figure 6:
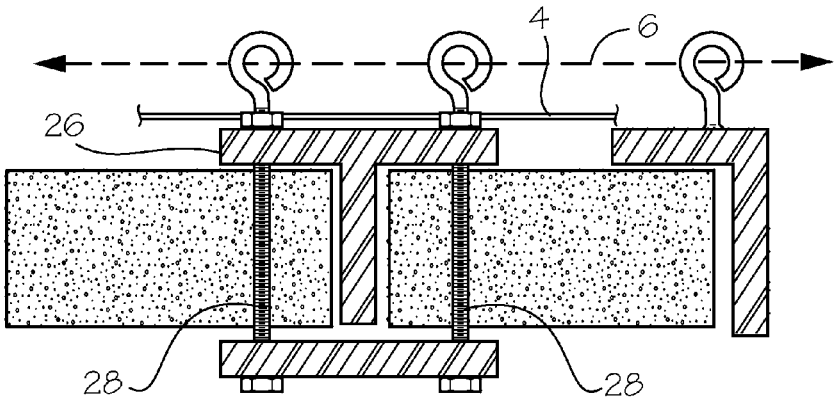
FIG. 6 is a perspective view illustrating an alternative method for installing roof insulation according to the invention.
Figure 7:
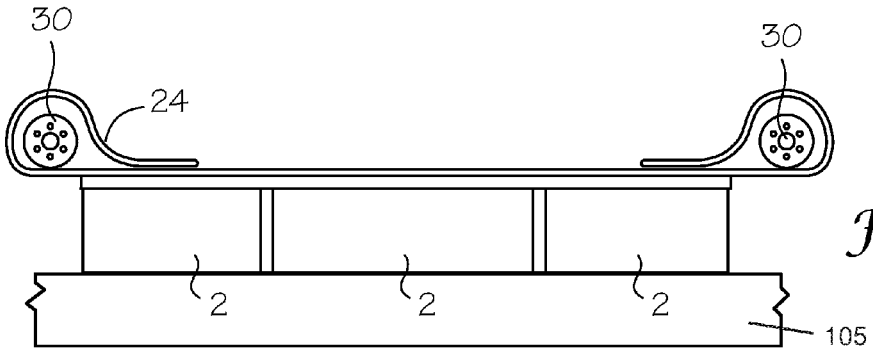
FIG. 7 is a side plan view illustrating installation of roof insulation according to the invention.

In another embodiment shown in FIG. 5, H-shaped tracks 22 are provided within the roof deck for insertion of the insulation sheets 2. The H-tracks hold the insulation sheets 2 in their general position so that the sheets can be secured by a cable 6 or strap system from above. Cables or straps 24 are run across the top of the tracks to secure the insulation sheets 2. In a related embodiment of FIG. 6, H-joints 26 are provided to secure the insulation sheets 2, and the insulation sheets are attached to the joints, such as by screws 28. The joints are attached to the bottom the membrane sheets to secure the position of the insulation sheets 2 within the roof deck. The membrane is then attached by cables, which secures the underlying joints and insulation sheets 2.

In another embodiment cable 6 may be used to as an attachment point or used to secure membrane. Straps 24 cross the insulation sheets 2 to secure them in place and attach to a secure member 30 or to the cables 6. Said cables may comprise reinforced members that act as cable structure, such as reinforced membrane sections. The straps 24 may wrap-around the cables and adhere to themselves. A system of straps provides a low profile structure for holding the insulation sheets 2 that will not cause water build-up on the roof.

I claim:

1. A method for installation of insulation sheets on a roof deck including the steps of:

providing an adherent material on a top surface of the insulation sheets;

providing a roofing membrane material;

installing insulation sheets on the roof deck;

installing the roofing membrane material over the insulation sheets on the roof deck;

adhering the roofing membrane material to the adherent material on the top surface of the insulation sheets;

laying elongate cable across the roofing membrane covering the insulation sheets; and securing the cable to the roof deck, whereby the roofing membrane material and insulation sheets are secured by the cable to the roof deck.

2. A method for installation of insulation sheets on a roof deck as in claim 1 in which said adherent material on the top surface of the insulation sheets is a hook and loop fastener and an adherent material comprised of hook and loop fastener is provided on a bottom surface of the roofing membrane material, and the step of adhering the roofing membrane material to the insulation sheets includes adhering the hook and loop fastener on the bottom surface of the roofing material to the hook and loop fastener on the top surface of the insulation sheets.

3. A method for installation of insulation sheets on a roof deck as in claim 2 in which the hook and loop fastener on the top surface of the insulation sheets comprises sectional strips of hook and loop fastener.

4. A method for installation of insulation sheets on a roof deck as in claim 3 in which the hook and loop fastener on the bottom surface of the roofing membrane material comprises sectional strips of hook and loop fastener.

5. A method for installation of insulation sheets on a roof deck as in claim 4 in which the sectional strips of hook and loop fastener on both the insulation sheets and the roofing membrane material are crisscrossed.

6. A method for installation of insulation sheets on a roof deck as in claim 1 in which said adherent material on the top surface of the insulation sheets is an adhesive with a pull-off covering and the step of adhering the roofing membrane material to the insulation sheets includes removing the pull-off covering on the top surface of the insulation sheets.

7. A method for installation of insulation sheets on a roof deck including the steps of:

providing top cross bars and bottom cross bars securing the insulation sheets on the roof deck and a section of the top cross bars and the bottom cross bars connecting between the insulation sheets;

providing a roofing membrane material;

installing the roofing membrane material over the insulation sheets on the roof deck;

laying elongate cable across the roofing membrane covering the insulation sheets; and securing the cable to the roof deck, whereby the roofing membrane material and insulation sheets are secured by the cable to the roof deck.

8. A method for installation of insulation sheets on a roof deck as in claim 7 in which said top cross bars include attachments for the elongate cable to pass through.

9. A method for installation of insulation sheets on a roof deck including the steps of:

providing H-tracks or H-joints holding the insulation sheets on the roof deck;

providing a roofing membrane material;

installing the roofing membrane material over the insulation sheets on the roof deck;

laying elongate cable across the roofing membrane covering the insulation sheets; and securing the cable to the roof deck, whereby the roofing membrane material and insulation sheets are secured by the cable to the roof deck.

* * * * *